United States Patent [19]

Moore

[11] Patent Number: 4,704,825

[45] Date of Patent: Nov. 10, 1987

[54] METHOD FOR AUTOMATICALLY SIZING A GROUND SURFACE ON A WORKPIECE

[75] Inventor: Wayne R. Moore, Trumbull, Conn.

[73] Assignee: Moore Special Tool Co., Inc., Bridgeport, Conn.

[21] Appl. No.: 902,889

[22] Filed: Sep. 2, 1986

[51] Int. Cl.[4] ..... B24B 1/00

[52] U.S. Cl. ..... 51/290; 51/165.71; 51/165.75; 51/165.93

[58] Field of Search ..... 51/165.88, 165.87, 165.77, 51/165.75, 90, 290, 165.71, 165.93

[56] References Cited

U.S. PATENT DOCUMENTS

| | | | |
|---|---|---|---|
| 2,584,499 | 2/1952 | Pyne | 51/165.88 |
| 3,526,060 | 9/1970 | Hall | 51/90 |
| 3,807,098 | 4/1974 | Schaller | 51/165.71 |
| 3,857,200 | 12/1974 | Hill | 51/165.75 |
| 4,274,231 | 6/1981 | Verega | 51/165.71 |
| 4,570,385 | 2/1986 | Richer | 51/165.71 |

*Primary Examiner*—Harold D. Whitehead

*Attorney, Agent, or Firm*—Kramer, Brufsky & Cifelli

[57] ABSTRACT

A method for automatically sizing a ground surface utilizes a detector having a reference edge position provided adjacent the rotatable spindle of a jig grinder. The jig grinder spindle center is moved a distance from the detector's reference edge equal to the finished radius value of the surface to be ground, or any known distance to be used as a datum. A tool or grinding wheel mounted for relative movement to the jig grinder centerline along the U-axis is moved relative to the jig grinder centerline to clear the detector's pick-up edge. Then, with the grind side of the grinding wheel facing the detector pick-up edge, the wheel is lowered and outfed back along the U-axis while in a conventional dynamic grinding mode until the wheel's outermost cutting position is equal to or in proximity to the detector's reference edge position, which can be confirmed by laser, force or sound apparatus. When contact is made, the outfeed is instantly stopped with no overtravel. This U-axis radial position relative to the position of the machine spindle centerline is the automatically sized radius value to be ground in the workpiece and is a datum or preset radial position to which the tool is moved relative to the jig grinder spindle centerline during the grinding mode.

5 Claims, 9 Drawing Figures

METHOD FOR AUTOMATICALLY SIZING A GROUND SURFACE ON A WORKPIECE

BACKGROUND AND SUMMARY OF THE INVENTION

This invention relates to a method for grinding a contoured surface on a workpiece, and more particularly, to a method for automatically assuring that the surface is automatically ground to a particular size.

Conventional grinding of contoured surfaces in a workpiece can be accomplished by use of a grinding tool mounted on a jig grinder. The tool, of cylindrical configuration, is mounted on a high speed rotatable grinding spindle. The machine also has a spindle which moves relative to an X and Y axis as well as vertically along a Z-axis, and can rotate about its own centerline and is known as the C-axis or machine spindle centerline. The tool is independently movable relative to the machine spindle and machine spindle centerline of the jig grinder along what is commonly termed as the U-axis, and can also rotate about its own centerline or spindle shaft.

The relative movement of the machine spindle of the jig grinder and tool along any combination of these axes can be automatically controlled by a computerized program to grind the workpiece in a contoured predetermined pattern which will result in a contoured shape. Alternatively, the grinding process can be performed manually.

This invention relates to a method for assuring that the ground shape of the contoured surface is properly dimensioned or automatically sized.

In accordance with the invention, a detector having a reference edge position is provided adjacent the rotatable machine spindle of the jig grinder. The machine spindle centerline of the jig grinder is moved a distance from the detector's reference edge equal to the finished radius size of the surface to be ground or any known distance, to be used as a datum. Using the U-axis, the tool or grinding wheel which is above the detector's edge, is moved relative to the jig grinder centerline to clear the detector's pick-up edge. Then, with the grind side of the grinding wheel facing the detector pick-up edge, and the grinding wheel in a grinding mode, the wheel is lowered and outfed back along the U-axis until the outermost cutting position of the grind side of the grinding wheel position is equal to or in some repeatable proximity to the position of the reference edge, as for example where the wheel just barely scrapes or makes contact with the detector pick-up edge, which can be confirmed by laser, force or sound apparatus. When this condition is present, the outfeed is instantly stopped with no over-travel. This U-axis radial position relative to the position of the C-axis spindle or static centerline of the jig grinder is automatically sized radius value to be ground in the workpiece and is the preset size or datum radial position to which the tool is to be moved during the grinding mode.

The jig grinder C-axis centerline can then be positioned by movement along a combination of the X and Y axes to the centerline (in plan evaluation) of, e.g., a hole to be ground in a workpiece, or an arcuate contoured surface which is to be ground. The tool with its spindle is then positioned to clear stock on the workpiece by movement along the U-axis relative to the jig grinder C-axis centerline (and raised and lowered along the Z-axis as necessary to clear the workpiece) and entered into the hole to be ground. With the grinding surface of the tool in contact with the stock, the tool is outfed along the U-axis back to the preset radius position or any other radius using the preset as a datum while using whatever conventional grinding methods and techniques are specified. When grinding is complete (i.e., all material has been ground away), and the grinding wheel is in its relative preset position, the surface has been automatically sized.

BRIEF DESCRIPTION OF THE DRAWINGS

Further objects and advantages of the invention will become more apparent from the following description and claims, and from the accompanying drawings, wherein:

FIGS. 2A–5A are views in side elevation corresponding to the steps illustrated in FIGS. 2–5, respectively.

DETAILED DESCRIPTION OF THE PREFERRED EMBODIMENT

Figure 1:
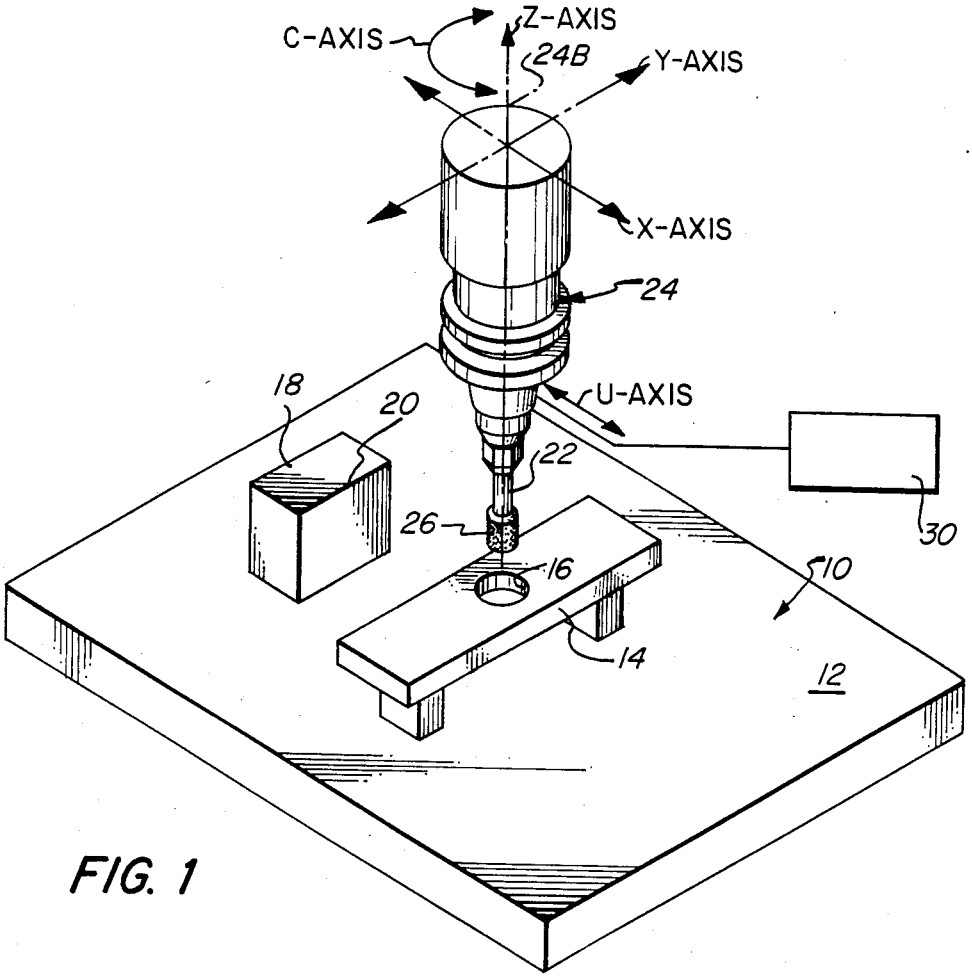
FIG. 1 is a diagrammatic perspective view of an apparatus which can be usd to carry out the method of the present invention.

Referring now to the drawings in detail, wherein like numerals indicate like elements throughout the several views, FIG. 1 illustrates an apparatus 10 for carrying out the method of the present invention.

The apparatus 10 includes a table 12 for holding a workpiece 14 provided with a roughly cut hole 16, which is illustrative only. Hole 16 can be any contoured surface which is to be ground along its edge and need not even be of a regular or defined shape.

A detector block 18 having a straight edge 20 is provided near or on the table 12 adjacent a rotatable tool spindle 22 mounted on a jig grinder 24. Spindle 22 has a cylindrical grinding tool 26 mounted thereon for movement up and down along the Z-axis and with planetary rotation about the C-axis (see FIG. 1) or centerline 24B of jig grinder 24. The tool spindle 22 also has independent relative movement with respect to the C-axis or machine spindle centerline 24B of the jig grinder 24 along a linear U-axis.

Figure 2:
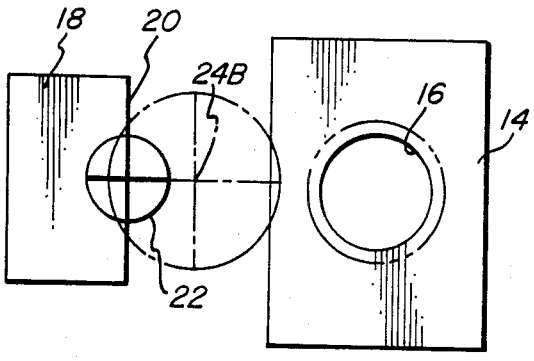
FIGS. 2 through 5, inclusive, are bottom plan views illustrating successive steps of the auto sizing procedure carried out by the apparatus of FIG. 1.
Figure 2A:
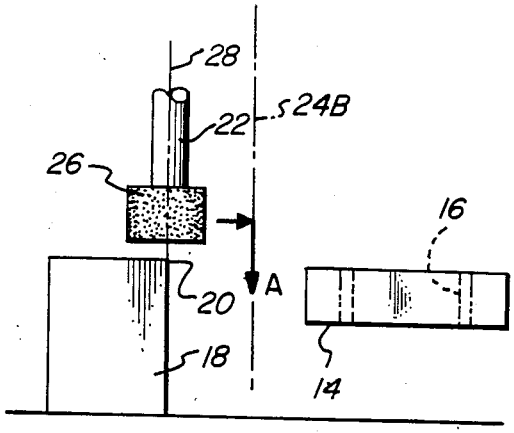
Figure 3:
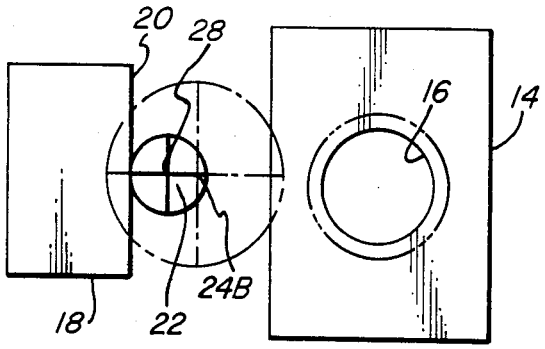
Figure 3A:
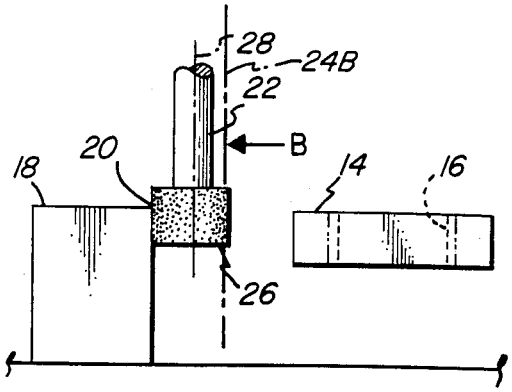

As shown in FIGS. 2 and 2A, when used to carry out the process of the present invention, e.g., to automatically size the surface surrounding hole 16 in workpiece 14, the jig grinder centerline 24B, is moved and located a distance from the detector's straight or reference edge 20 equal to the finished radius size of the surface to be ground. Using the U-axis, the tool or grinding wheel 26, normally above the edge 20, is then moved relative to the centerline 24B to clear the detector's pick-up edge if necessary, and lowered as shown by the arrow A in FIG. 2A. Then, with the grind side of the grinding wheel 26 facing the detector pick-up edge 20, and while in a conventional dynamic grinding mode, the wheel 26 is outfed along the U-axis back towards the edge 20 as shown by arrow B in FIG. 3A until the outermost cutting position on the grind side of the grinding wheel 26 is equal to, or in some close and repeatable proximity to the reference detector's edge 20, e.g., where the wheel makes scraping contact with detector pick-up edge 20, which can be confirmed by laser, force or sound apparatus. When contact is made, the outfeed is instantly stopped with no over-travel. This U-axis radial position of the grinding wheel 26 and its spindle centerline 28 relative to the jig grinder centerline 24B is the automatically sized radius value to be ground in the workpiece and is the preset radial position to which the tool 26 is to be moved during the grinding mode.

Figure 4:
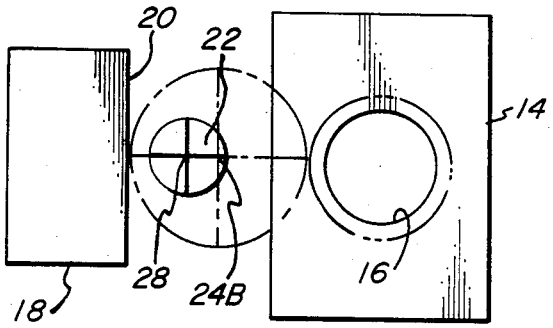
Figure 4A:
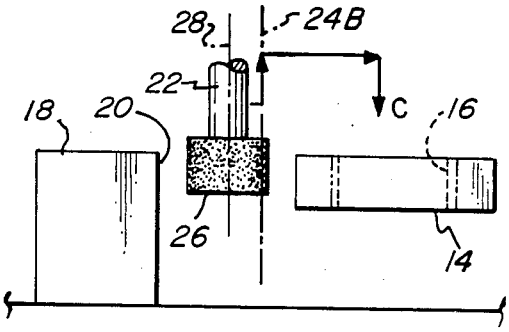
Figure 5:
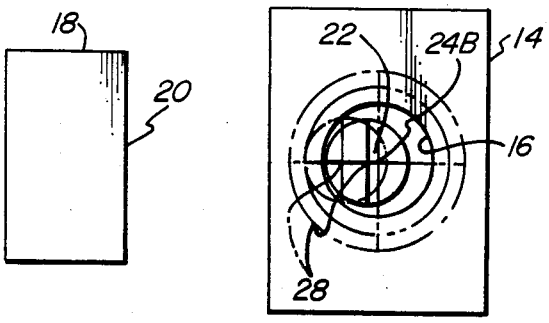
Figure 5A:
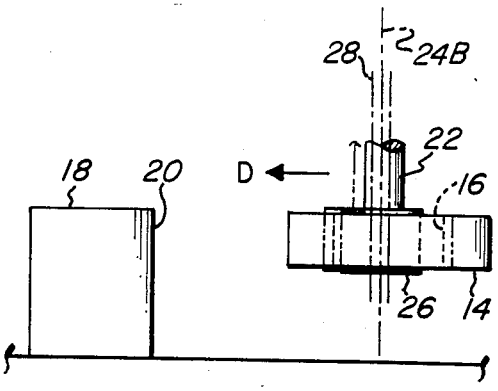

The jig grinder centerline 24B can then be positioned by movement along the X and Y axes to, e.g., the centerline (in plan evaluation) of the hole 16 to be ground in the workpiece 14 as shown in FIG. 5. The tool 26 is then moved back along the U-axis relative to the jig grinder centerline 24B (and raised and lowered along the Z-axis as necessary) as indicated by arrow C in FIG. 4A to clear the workpiece 14 and enter the hole 16 to be ground. With the grinding surface of the tool 26 in contact with the stock as shown in FIGS. 5 and 5A, the tool is outfed along the U-axis back to the preset radius position as indicated by the arrow D in FIG. 5A, while in some conventional dynamic grinding mode as called for in the work.

The automatic sizing procedure need not be continuous, but movement along the U-axis may be in reciprocable movements to precisely locate the final or datum "outfeed" position or edge 20. For example, automatic sizing with a contact or force detector can be continued until contact of the grinding wheel 26 with the preset radial or pick-up edge 20 position is made. Outfeed along the U-axis then stops instantly, and the grinding wheel 26 is backed away slightly along the U-axis, while the centerline 24B of jig grinder 24 is also repositioned along the Y-axis to correspond to a fresh or unused pick-up edge position along the U-axis of the grinding wheel 26. Now being close to the pick-up edge, the grinding wheel 26 is moved in small increments along the U-axis towards the pick-up edge position. When contact is again made, the U-axis travel stops instantly. After backing away a second time, and careful pick-up of the contact position is again repeated, the average of the latter two positions is automatically calculated and this final "outfeed" position relative to the jig grinder centerline 24B is transmitted to the computer memory 30 and final grinding to the radius is initiated and completed.

If the surface to be ground has an irregular shape or contour, as compared to a round hole 16, the grinding tool or wheel 26 should fit within the smallest internal radius of the opening adjacent the surface to be ground and all measurements for stock removal are correlated to this location. The tool 26 and centerline 24B will be caused to travel by the memory 30 in the preset irregular path grinding off material from the surface equal in amount to the difference from the final setting of the centerline 24B to the edge 20 at the various points of reference taken about the irregular path.

What is claimed as new is as follows:

1. A method for automatically sizing a ground surface on a workpiece comprising the steps of:

(a) providing a detector having a reference edge in proximity to a substantially cylindrical grinding tool mounted for independent movement along a linear U-axis relative to the centerline of a rotatable machine spindle;

(b) positioning the centerline of said machine spindle a known distance from said detector edge;

(c) moving said grinding tool along said U-axis so that the outermost cutting position of said grinding tool is detected by the reference edge position of said detector;

(d) calibrating the position of said grinding tool relative to the position of the machine spindle centerline by recording the grinding tool position along said U-axis upon detection of said outermost cutting position by said detector;

(e) moving said spindle centerline so that it is centered in plan evaluation along the radius to be ground;

(f) positioning said grinding surface of said tool against a surface on a workpiece to be ground; and (g) initiating grinding of said workpiece allowing said grinding tool to proceed along said U-axis for a predetermined distance relative to the machine spindle centerline based on the calibration established at step (d).

2. The method of claim 1 wherein said recording steps are performed on a computerized memory.

3. The method of claim 1 wherein said recording steps are performed manually.

4. The method of claim 1 wherein said surface to be ground on said workpiece has a regular contour or shape.

5. The method of claim 1 wherein said surface to be ground on said workpiece has an irregular contour or shape.

* * * * *

UNITED STATES PATENT AND TRADEMARK OFFICE

CERTIFICATE OF CORRECTION

PATENT NO. : 4,704,825

DATED : November 10, 1987

INVENTOR(S) : Wayne R. Moore

It is certified that error appears in the above-identified patent and that said Letters Patent is hereby corrected as shown below:

In Claim 1, column 4, line 27 thereof, "evaluation" should read -- elevation -- .

Signed and Sealed this

Twenty-ninth Day of March, 1988

*Attest:*

DONALD J. QUIGG

*Attesting Officer*

*Commissioner of Patents and Trademarks*